US005815070A

United States Patent [19]

Yoshikawa

[11] Patent Number: 5,815,070

[45] Date of Patent: Sep. 29, 1998

[54] DRIVING STATE-MONITORING APPARATUS FOR AUTOMOTIVE VEHICLES

[75] Inventor: Kenji Yoshikawa, Wako, Japan

[73] Assignee: Honda Giken Kogyo Kabushiki Kaisha, Tokyo, Japan

[21] Appl. No.: 690,796

[22] Filed: Aug. 1, 1996

[30] Foreign Application Priority Data

Aug. 1, 1995 [JP] Japan ..... 7-214001

[51] Int. Cl.[6] ..... G08B 21/00

[52] U.S. Cl. ..... 340/439; 340/575; 340/576; 180/272; 701/29; 701/35

[58] Field of Search ..... 340/575, 576, 340/438, 439, 441, 904, 905; 364/424.01, 424.04; 180/272; 701/29, 35

[56] References Cited

U.S. PATENT DOCUMENTS

| | | | |
|---|---|---|---|
| 4,293,844 | 10/1981 | Ruhl | 340/439 |
| 4,395,624 | 7/1983 | Wartski | 364/424.04 |
| 4,594,583 | 6/1986 | Seko et al. | 340/576 |
| 4,604,611 | 8/1986 | Seko et al. | 340/575 |
| 5,465,079 | 11/1995 | Bouchard et al. | 340/576 |
| 5,574,641 | 11/1996 | Kawakami et al. | 340/575 |

FOREIGN PATENT DOCUMENTS 585221 6/1993 Japan .

*Primary Examiner*—Edward Lefkowitz
*Attorney, Agent, or Firm*—Weiner, Carrier, Burt & Esser, P.C.; Joseph P. Carrier

[57] ABSTRACT

A driving state-monitoring apparatus for an automotive vehicle monitors a driving state of a driver of the automotive vehicle. A driving state parameter indicative of the driving state of the driver is calculated based on at least one of behavior of the automotive vehicle, a driving operation of the driver, and a condition of the driver. The driving state parameter is compared with a reference value. It is determined whether or not the driving state of the driver is normal, based on a result of the comparison. The reference value is changed based on the driving state parameter in such a direction that it becomes less possible to determine that the driving state of the driver is normal.

16 Claims, 11 Drawing Sheets

| | $\sigma$ DIF > $\sigma$ TH | $\sigma$ DIF ≦ $\sigma$ TH |
|---|---|---|
| Δ DIFAVE > Δ DIFTH | C | D |
| Δ DIFAVE ≦ Δ DIFTH | B | A |

DRIVING STATE-MONITORING APPARATUS FOR AUTOMOTIVE VEHICLES

BACKGROUND OF THE INVENTION

1. Field of the Invention

This invention relates to a driving state-monitoring apparatus for automotive vehicles, which monitors the driving state of the driver of the automotive vehicle, and gives an alarm, if necessary.

2. Prior Art

Conventionally, a driving state-monitoring apparatus has been proposed e.g. by Japanese Laid-Open Patent Publication (Kokai) No. 5-85221, which estimates a delay in response of the driver of an automotive vehicle and the difference between the actual position of the vehicle and a lane on which the vehicle is traveling (reference position of the vehicle in the lane), based on an amount of steering of the vehicle performed by the driver and the vehicle speed, and compares the estimated delay in response and the estimated difference with respective reference values to be assumed during normal driving states of the driver, to thereby check the driving state of the driver e.g. for abnormal steering caused by dozing or lowered driving ability of the driver resulting from his fatigue.

However, the reference values of the estimated delay in response and the estimated difference to be assumed during normal driving states of the driver, which are employed for checking the driving state of the driver are not necessarily constant. For example, just after the driver starts driving the vehicle, due to the fact that it takes some time for the driver to become fully adjusted to the driving of the vehicle, the amount of steering of the vehicle by the driver tends to be larger than after he has become fully adjusted to the driving. Therefore, there is a high possibility that the driving state of the driver is erroneously determined to be abnormal even when it is actually normal.

SUMMARY OF THE INVENTION

It is an object of the invention to provide a driving state-monitoring apparatus for an automotive vehicle, which is capable of determining a driving state of the driver with enhanced accuracy by setting a reference value of a parameter or reference values of parameters applied in the determination in a more suitable manner.

To attain the above object, the present invention provides a driving state-monitoring apparatus for an automotive vehicle, for monitoring a driving state of a driver of the automotive vehicle, comprising:

driving state parameter-calculating means for calculating a driving state parameter indicative of the driving state of the driver based on at least one of behavior of the automotive vehicle, a driving operation of the driver, and a condition of the driver;

comparison means for comparing the driving state parameter with a reference value;

determining means for determining whether or not the driving state of the driver is normal based on a result of the comparison by the comparison means; and reference value-changing means for changing the reference value based on the driving state parameter calculated by the driving state parameter-calculating means, in such a direction that it becomes less possible to determine that the driving state of the driver is normal.

Preferably, the reference value-changing means progressively changes the reference value based on the driving state parameter calculated by the driving state parameter-calculating means in such a direction that it becomes less possible to determine that the driving state of the driver is normal, after the automotive vehicle is started.

Preferably, the driving state-monitoring apparatus includes inhibiting means for inhibiting the reference value-changing means from changing the reference value once the determining means determines that the driving state of the driver is not normal.

Preferably, the driving state-monitoring apparatus includes inhibiting means for inhibiting the reference value-changing means from changing the reference value before a predetermined time period elapses after the automotive vehicle is started.

Preferably, the driving state-monitoring apparatus includes alarm means for giving an alarm when the determining means determines that the driving state of the driver is not normal, and inhibiting means for inhibiting the alarm means from giving the alarm before a predetermined time period elapses after the automotive vehicle is started.

Preferably, the driving state parameter-calculating means includes behavior parameter-detecting means for detecting a behavior parameter indicative of an amount of behavior related to at least one of yawing movement and lateral movement of the automotive vehicle, vehicle speed-detecting means for detecting a speed of the automotive vehicle, behavior reference parameter-setting means for setting a behavior reference parameter based on changes in the behavior parameter, and lateral deviation behavior amount-calculating means for calculating a lateral deviation behavior amount of the automotive vehicle, based on the behavior parameter, the behavior reference parameter, and the speed of the automotive vehicle, and calculates the driving state parameter based on the lateral deviation behavior amount of the automotive vehicle.

Preferably, the comparison means compares an average value of the driving state parameter and a variation of the driving state parameter with respective reference values, and the determining means includes driving ability-determining means for determining a driving ability of the driver based on the result of the comparison by the comparison means. The determining means determines whether or not the driving state of the driver is normal, based on a result of the determination by the driving ability-determining means.

Preferably, the driving state-monitoring apparatus includes lane changing intention-determining means for determining whether or not the driver intends to change a lane on which the automotive vehicle is traveling, and inhibiting means for inhibiting the determining means from carrying out the determination as to normality of the driving state of the driver based on the result of the comparison by the comparison means.

Preferably, the driving state-monitoring apparatus includes vehicle speed-limiting means responsive to the determination by the determining means that the driving state of the driver is not normal, for limiting the speed of the automotive vehicle.

Preferably, the automotive vehicle includes equipment installed on the automotive vehicle for directly applying a physical force or stimulation on the driver, and the apparatus includes vehicle equipment control means responsive to the determination by the determining means that the driving state of the driver is not normal, for controlling the equipment.

Preferably, the driving state-monitoring apparatus includes initial value-setting means for setting the reference value to an initial value when the automotive vehicle is started, and after the automotive vehicle is started, the reference value-changing means calculates a new value of the reference value based on an average value of the driving state parameter and a standard deviation of the driving state parameter, and updates the reference value by the new value of the reference value.

The above and other objects, features, and advantages of the invention will become more apparent from the following detailed description taken in conjunction with the accompanying drawings.

BRIEF DESCRIPTION OF THE DRAWINGS

FIG. 2A to FIG. 2E are graphs showing examples of changes in detection data and parameters calculated based on the detection data, in which:

FIG. 2A shows changes in a yaw rate YR;

FIG. 2B shows changes in a yaw angle YA;

FIG. 2C shows changes in a modified yaw angle YAM;

FIG. 2D shows changes in a lateral deviation differential quantity DYK; and

FIG. 2E shows changes in a lateral deviation YK;

DETAILED DESCRIPTION

The invention will now be described in detail with reference to the drawings showing embodiments thereof.

Figure 1:
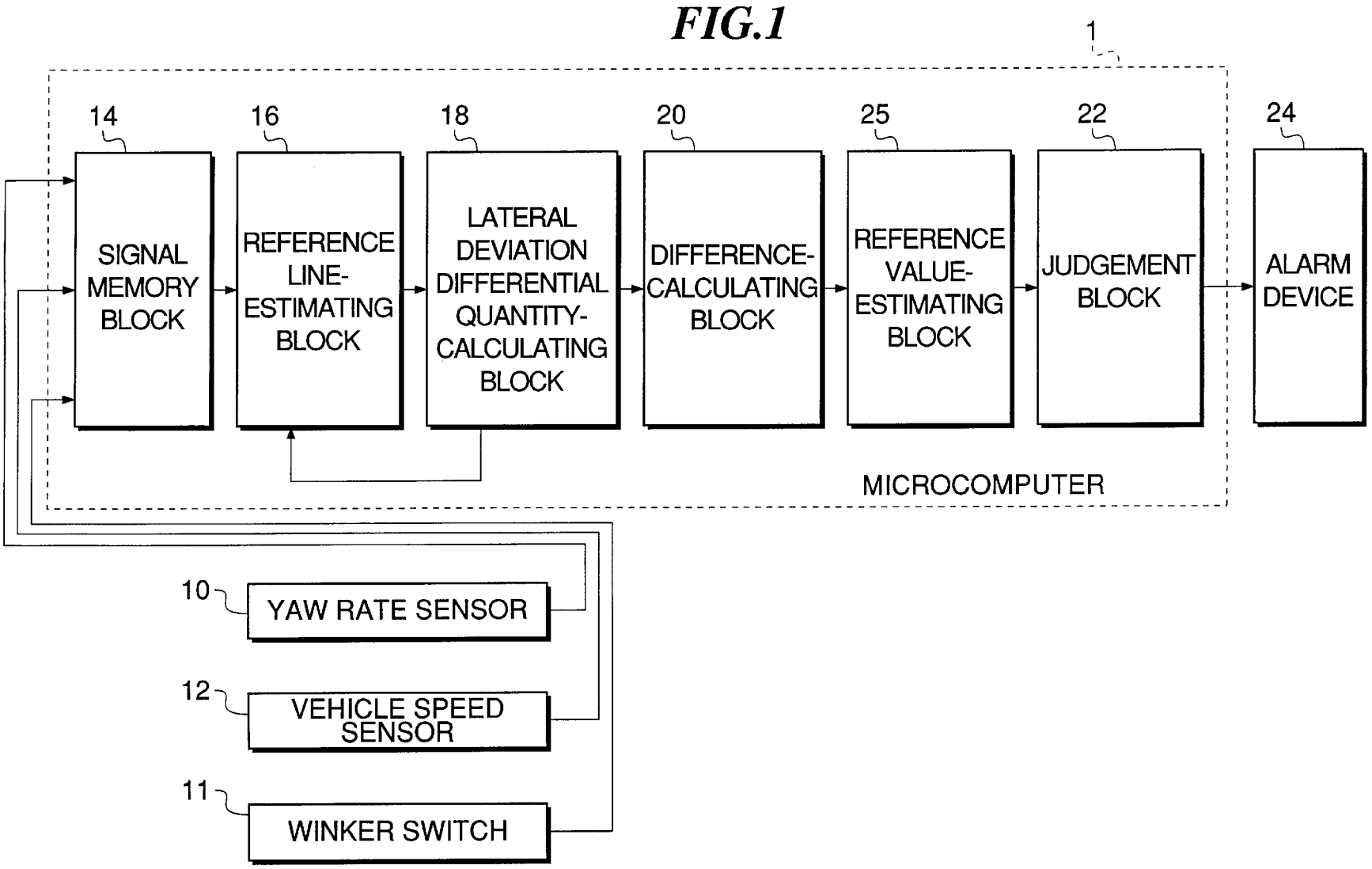
FIG. 1 is a block diagram showing the arrangement of a driving state-monitoring apparatus for an automotive vehicle, according to a first embodiment of the invention.

Referring first to FIG. 1, there is shown the arrangement of a driving state-monitoring apparatus for an automotive vehicle, according to a first embodiment of the invention. The apparatus is installed on the vehicle which is driven by a prime mover, such as an internal combustion engine and an electric motor, and is equipped with a steering handle or wheel. In the figure, reference numeral 1 designates a microcomputer which has an input to which are connected a yaw rate sensor 10 for detecting the yaw rate of the vehicle, a vehicle speed sensor 12 for detecting the traveling speed of the vehicle, and a winker switch 11 for detecting the driver's intention of changing the traffic lane. The microcomputer 1 has an output to which is connected an alarm device 24 for giving an alarm if necessary during monitoring of the driving state of the driver. The alarm device 24 may be formed e.g. by a lamp, a buzzer, or a voice generator.

The microcomputer 1 has functions which are represented as functional blocks in FIG. 1, i.e. a signal memory block 14, a reference line-estimating block 16, a lateral deviation differential quantity-calculating block 18, a difference-calculating block 20, a reference value-estimating block 25, and a judgement block 22.

The signal memory block 14 stores input signals from the sensors 10, 12 and the switch 11, and updates yaw rate data and vehicle speed data obtained over a predetermined time period T1 (e.g. 30 seconds) before the present time whenever a predetermined time period (e.g. 10 seconds) elapses. The updated data are delivered to the reference line-estimating block 16.

Figure 2A:
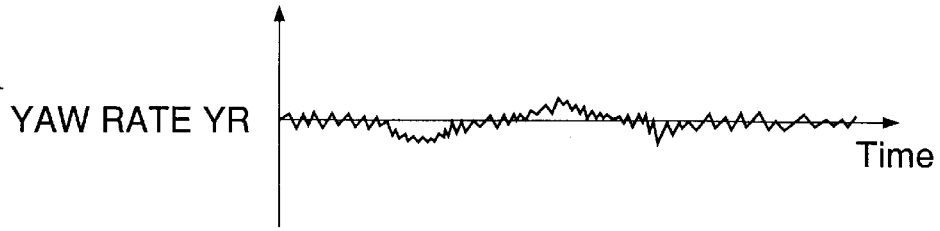
Figure 2B:
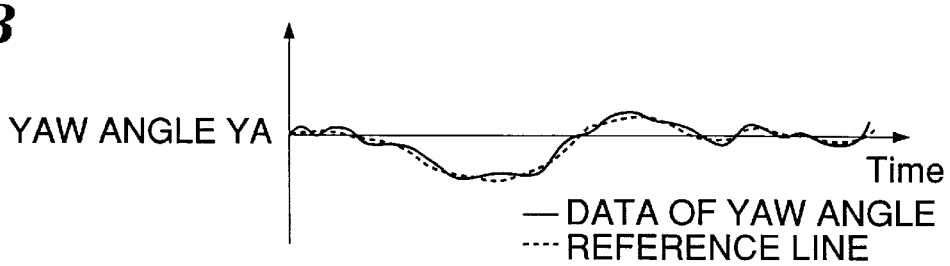

The reference line-estimating block 16 time-integrates the input yaw rate (FIG. 2A) into a yaw angle YA (FIG. 2B), and further calculates a reference line (indicated by the broken line in FIG. 2B), based on the yaw angle. Specifically, this calculation is carried out by a least-square method, which is well known, in the following manner:

Let it be assumed, e.g. that yaw angle values YA1, YA2, and YA3 were obtained at time points t1, t2, and t3, respectively. The reference line can be approximated by the following linear expressions (1a) to (1c):

$$YA1=b1+b2t1+e1 \quad (1a)$$

$$YA2=b1+b2t2+e2 \quad (1b)$$

$$YA3=b1+b2t3+e3 \quad (1c)$$

where e1 to e3 represent remaining differences, and terms b1 and b2 are determined such that the sum of the squares of the remaining differences e1 to e3 becomes the minimum. The reference line can also be approximated by the following quadratic expressions (2a) to (2c):

$$YA1=b1+b2t1+b3t1^2+e1 \quad (2a)$$

$$YA2=b1+b2t2+b3t2^2+e2 \quad (2b)$$

$$YA3=b1+b2t3+b3t3^2+e3 \quad (2c)$$

where terms b1 to b3 are determined such that the sum of the squares of the remaining differences e1 to e3 becomes the minimum.

Further, the reference line can be approximated by the following cubic expressions (3a) to (3c):

$$YA1=b1+b2t1+b3t1^2+b4t1^3+e1 \quad (3a)$$

$$YA2=b1+b2t2+b3t2^2+b4t2^3+e2 \quad (3b)$$

$$YA3=b1+b2t3+b3t3^2+b4t3^3+e3 \quad (3c)$$

where terms b1 to b4 are determined such that the sum of the squares of the remaining differences e1 to e3 becomes the minimum.

When the number of sampled data items is larger, the degree of expressions is further increased in a similar manner for more accurate approximation.

Figure 2C:
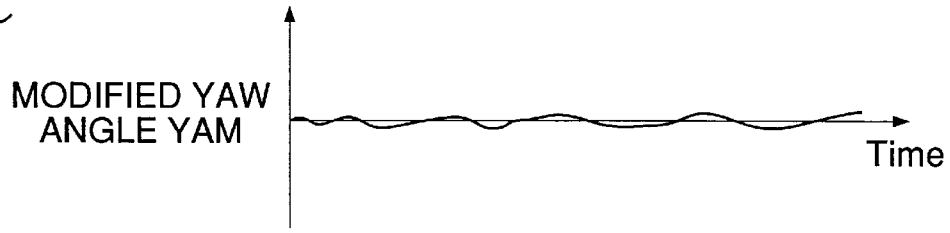

In the present embodiment, first, the reference line is determined by the linear expressions, and then a modified yaw angle YAM (FIG. 2C) is calculated by subtracting a reference yaw angle corresponding to the reference line from the determined yaw angle YA. The calculated modified yaw angle YAM is delivered to the lateral deviation differential quantity-calculating block 18.

Figure 2D:
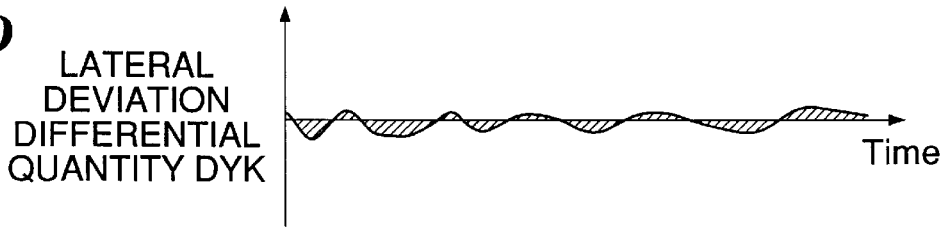

The lateral deviation differential quantity-calculating block 18 calculates a lateral deviation differential quantity DYK (FIG. 2D) by applying the modified yaw angle YAM and the vehicle speed V to the following equation (4):

$$DYK=V\times\sin(YAM) \tag{4}$$

When the difference between the maximum value DYKMAX of the lateral deviation differential quantity DYK and the minimum value DYKMIN of the same is equal to or larger than a predetermined value $\alpha 1$, the order of approximation of the reference line is increased to again determine the reference line, based on which the lateral deviation differential quantity DYK is again calculated. This procedure is repeatedly carried out until (DYKMAX−DYKMIN) $<\alpha 1$ holds.

Alternatively, the calculation of the reference line may be terminated when the order of approximation of the reference line has reached a predetermined value, even if (DYKMAX−DYKMIN)$\geqq\alpha 1$ holds.

The difference-calculating block 20 calculates a difference ΔDIF1, based on the lateral deviation differential quantity DYK. The difference ΔDIF1 is calculated e.g. as the sum of the hatched areas (value obtained by time-integrating the absolute value of the lateral deviation differential quantity DYK) shown in FIG. 2D. Alternatively, a standard deviation of the DYK value or the difference between the maximum value of the DYK value and the minimum value of the same may be used.

The reference value-estimating block 25 estimates and sets a reference value ΔDIFLIM1 used by the judgement block 22, based on the difference ΔDIF1.

More specifically, whenever an x number (e.g. 30) of values of the difference ΔDIF1 have been calculated, an average value MΔDIF1 of the difference ΔDIF1 and a standard deviation SΔDIF1 of the same are calculated, and the reference value ΔDIFLIM1 used by the judgement block 22 is updated by the use of the following equation (5):

$$\Delta DIFLIM1(k)=min(\Delta DIFLIM1(k-1),\ C0\times M\Delta DIF1+d0\times S\Delta DIF1) \tag{5}$$

where C0 and d0 represent predetermined values, and (k) and (k−1) indicate that values with these suffixes are obtained in the present loop and the immediately preceding loop, respectively. The reference value Δ DIFLIM1 is set to a predetermined initial value when the driver starts driving the vehicle. Further, min(A, B) represents an arithmetic operation in which the smaller of A and B is selected.

When the difference ΔDIF1 exceeds the reference value ΔDIFLIM1 and at the same time the winker switch 11 is not in operation, it means that the vehicle has largely deviated from the reference line without the driver's intention of changing the traffic lane, and hence the judgement block 22 judges that the driving state of the driver is abnormal, thereby delivering a signal for instructing the alarm device 24 to give an alarm.

As described above, according to the present embodiment, the reference line is calculated based on the yaw angle YA detected, and the driving state of the driver is judged based on the difference ΔDIF1 which is indicative of a deviation from the reference line and calculated from the lateral deviation differential quantity DYK. Therefore, it is possible to accurately determine the driving state of the driver, irrespective of the road surface conditions and variations in driving skill between individual drivers. Further, according to the present embodiment, an alarm is given in dependence on the operative state of the winker as well, which prevents an erroneous judgement as to abnormality of the driving state when a change of the course is intended by the driver.

Figure 4:
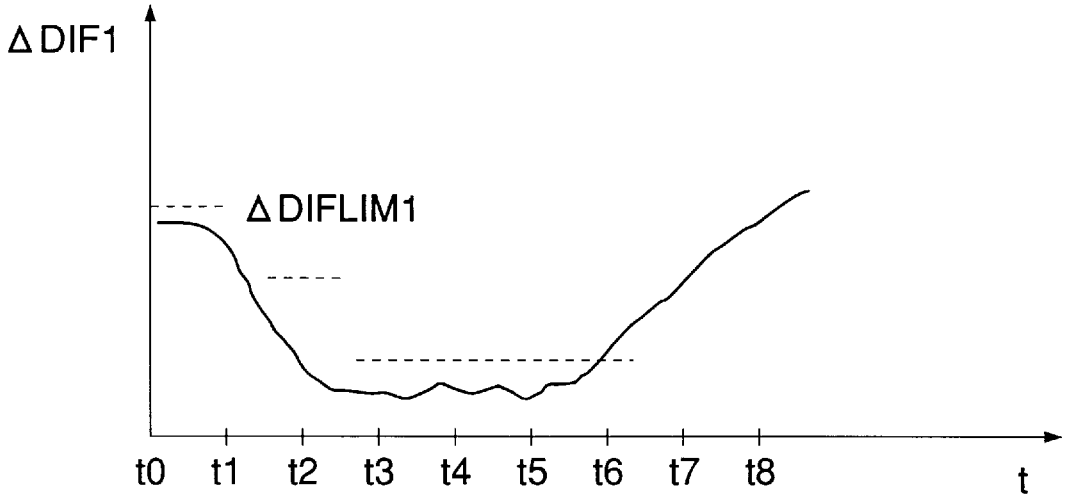
FIG. 4 is a graph showing an example of changes in a difference ΔDIF1 as a parameter indicative of behavior of the vehicle occurring immediately after the driver starts driving the vehicle.

FIG. 4 shows an example of changes in the difference ΔDIF1 after the start (time point t0) of the driving of the vehicle. Immediately after the driver starts driving the vehicle, the driver is not fully adjusted to the driving of the vehicle, and therefore the difference ΔDIF1 tends to assume relatively large values even when the driving state of the driver is normal, and subsequently progressively assume smaller values with the lapse of time. With this tendency taken into account, the reference value-estimating block 25 sets the reference value ΔDIFLIM1 in a progressively decreasing manner, as indicated by broken lines in the figure. Thereafter, if the difference Δ DIF1 is increased e.g. due to a doze of the driver, it is determined that the driving ability of the driver is lowered (at a time point t6).

Thus, the difference ΔDIF1 is decreased from its predetermined initial value set at the start of driving, based on the average value MΔDIF1 of the difference ΔDIF1 and the standard deviation SΔDIF1 of the same. This makes it possible to quickly determine whether or not the driving state of the driver is abnormal while preventing the driving state of the driver from being erroneously determined to be abnormal immediately after the driver starts driving the vehicle.

Figure 3:
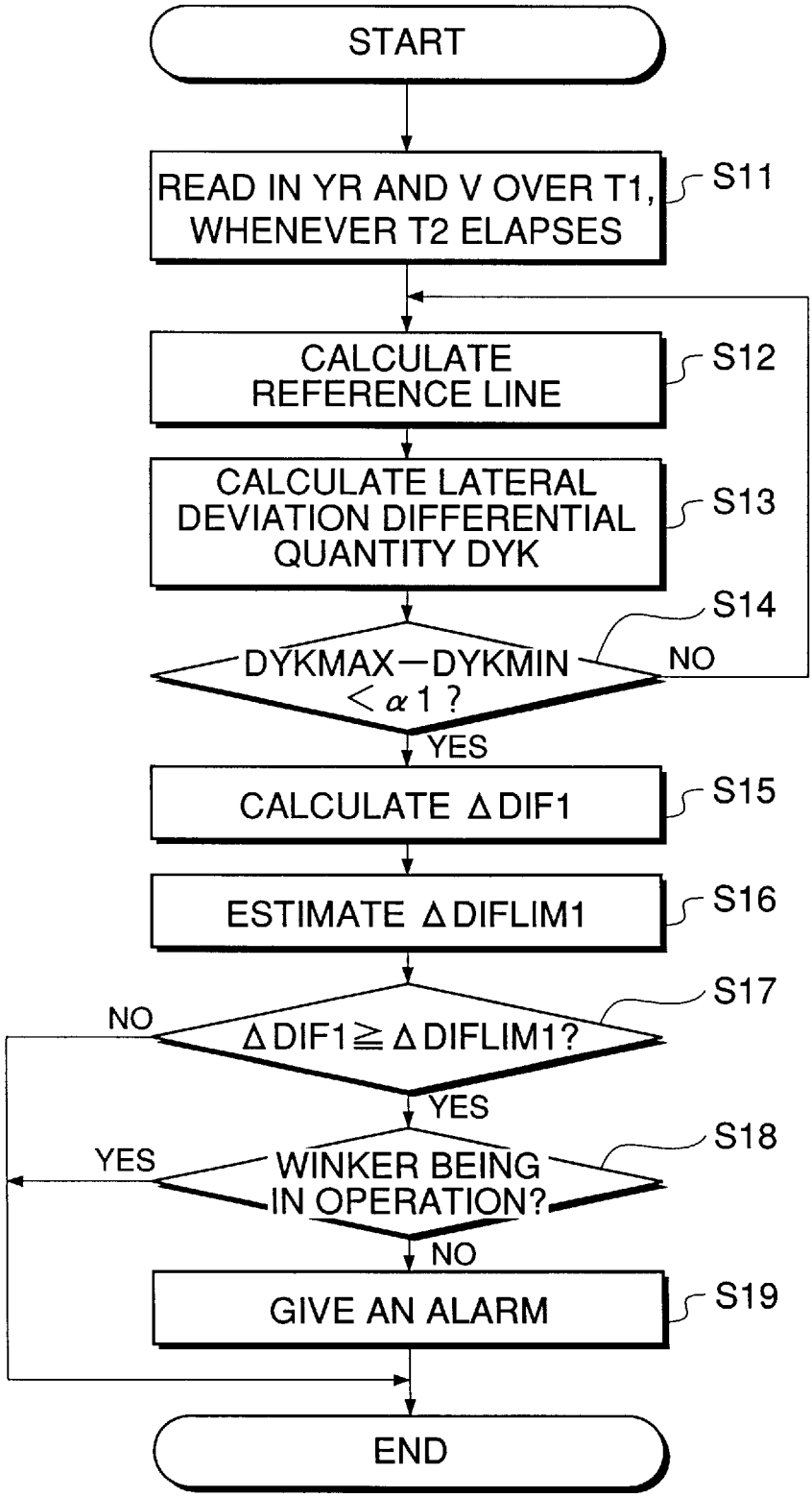
FIG. 3 is a flowchart showing a program for carrying out monitoring processing, which is executed by a microcomputer appearing in FIG. 1.

FIG. 3 shows a control processing routine executed by the microcomputer 1 for monitoring the driving state of the driver. The functions of the reference line-estimating block 16, the lateral deviation differential amount-calculating block 18, the difference-calculating block 20, the reference value-estimating block 25, and the judgement block 22 are implemented by the CPU of the microcomputer 1.

First, at a step S11, data of the yaw rate YR and the vehicle speed V detected over the predetermined time period T1 are read in whenever the predetermined time period T2 elapses. Then, the reference line and the lateral deviation differential quantity DYK are calculated by the use of the yaw rate Y data and the vehicle speed V data in the manners described hereinbefore at steps S12 and S13, respectively. At the following step S14, it is determined whether or not the difference between the maximum value DYKMAX of the lateral deviation differential quantity DYK and the minimum value DYKMIN of the same is smaller than the predetermined value $\alpha 1$. If (DYKMAX−DYKMIN)$\geqq\alpha 1$ holds, the program returns to the step S12, wherein the order of approximation is increased by one order to again calculate the reference line. This procedure is repeatedly carried out until the answer to the question of the step S14 becomes affirmative (YES).

As mentioned hereinbefore, the program may be configured such that the calculation of the reference line is terminated when the order of approximation has reached a predetermined value.

If (DYKMAX−DYKMIN)$<\alpha 1$ holds at the step S14, the program proceeds to a step S15, wherein the difference ΔDIF1 is calculated. Then, the reference value ΔDIFLIM1, referred to hereinabove, is updated based on the difference ΔDIF1 at a step S16, and it is determined at a step S17 whether or not the difference ΔDIF1 is equal to or larger than the reference value ΔDIFLIM1. If ΔDIF1≧ΔDIFLIM1 holds, it is determined at a step S18 whether or not the winker is in operation. If ΔDIF1<ΔDIFLIM1 holds or if the winker is in operation, the program is immediately terminated, whereas if ΔDIF1≧ΔDIFLIM1 holds and at the same time the winker is not in operation, it is determined that the driving state of the driver is abnormal and a signal is delivered to the alarm device 24 for instructing the same to give an alarm at a step S19.

Next, first and second variations of the first embodiment will be described.

The updating of the reference value ΔDIFLIM1 may be inhibited once it is determined that the driving state of the driver is abnormal for the first time after the driver started driving the vehicle (first variation of the first embodiment).

Figure 5A:
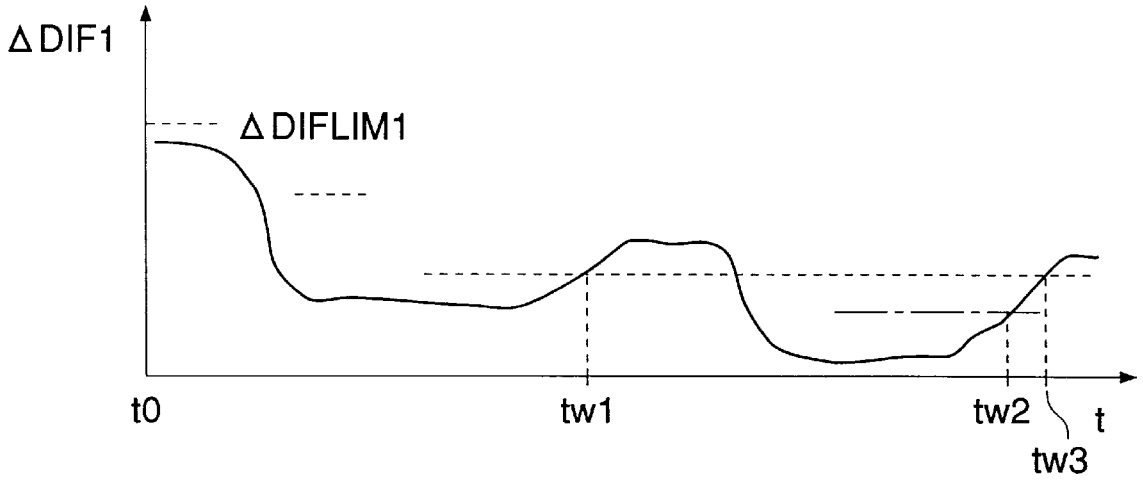
FIG. 5A is a graph which is useful in explaining a first variation of the first embodiment.

According to this variation, as shown in FIG. 5A, after a first alarm is given at a time point tW1, the reference value ΔDIFLIM1 is not updated to a smaller value, so that the alarm is given thereafter at the same level of meandering of the vehicle (i.e. the difference ΔDIF1) e.g. at a time point tW3 in the illustrated example. This prevents alarms given at different levels of meandering of the vehicle from causing a sense of incompatibility to the driver. Further, if the reference value ΔDIFLIM1 is set to an excessively low value (as indicated by a one-dot-chain line in the figure), the alarm can be given (at a time point tW2) in spite of sufficient awakeness of the driver, which makes alarming unnecessary. According to the present variation, it is possible to prevent the reference value ΔDIFLIM1 from being set to such an excessively low value, thereby preventing the driver from having a nuisance of unnecessarily given alarms.

Figure 5B:
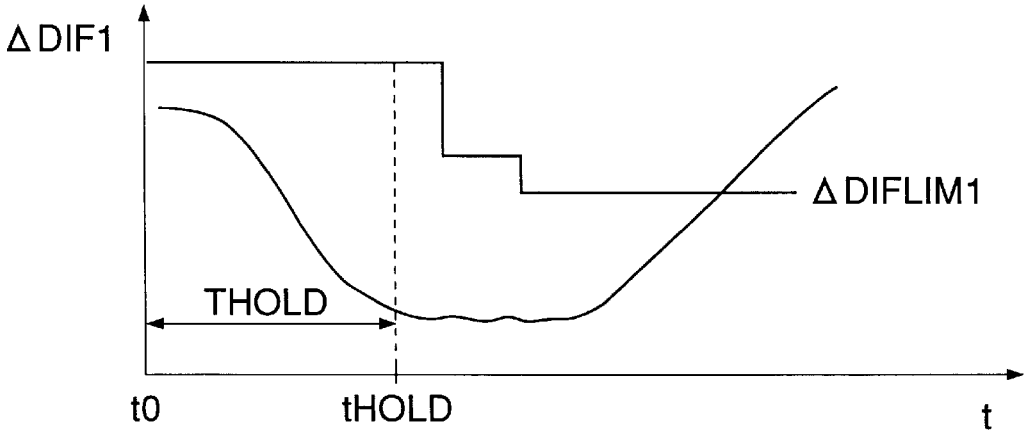
FIG. 5B is a graph which is useful in explaining a second variation of the first embodiment.

Alternatively, the reference value ΔDIFLIM1 may be set to an initial value slightly larger than an ordinary value when the driver starts driving the vehicle, and held at the initial value before a predetermined time period tHOLD elapses after the start of driving of the vehicle, as shown in FIG. 5B, without executing the updating of the reference value by the use of the equation (5) (second variation of the first embodiment).

Thus, immediately after the driver starts driving the vehicle, the reference value ΔDIFLIM1 is set and held at the initial value slightly larger than an ordinary value while inhibiting the updating of the same, whereby it is possible to prevent an erroneous alarm from being given due to an improper variation in the reference value ΔDIFLIM1.

As a further variation of the first embodiment, in view of the tendency that the difference ΔDIF1 assumes larger values immediately after the driver starts driving the vehicle, the driving state-monitoring apparatus may be configured such that alarming is inhibited irrespective of values of the difference ΔDIF1 assumed, before a predetermined no-alarm time period TNWARN elapses after the driver starts driving the vehicle. Similarly, the FIG. 3 program may be configured such that within the predetermined no-alarm time period, the program is immediately terminated after executing the step S15, thereby inhibiting the execution of the steps S16 to S19. Further, the FIG. 3 program may be configured such that within the predetermined no-alarm time period TNWARN, the execution of the step S12 et seq. is inhibited provided that the detected values of the vehicle speed V and/or the yaw rate YR are smaller than respective predetermined values.

Figure 6:
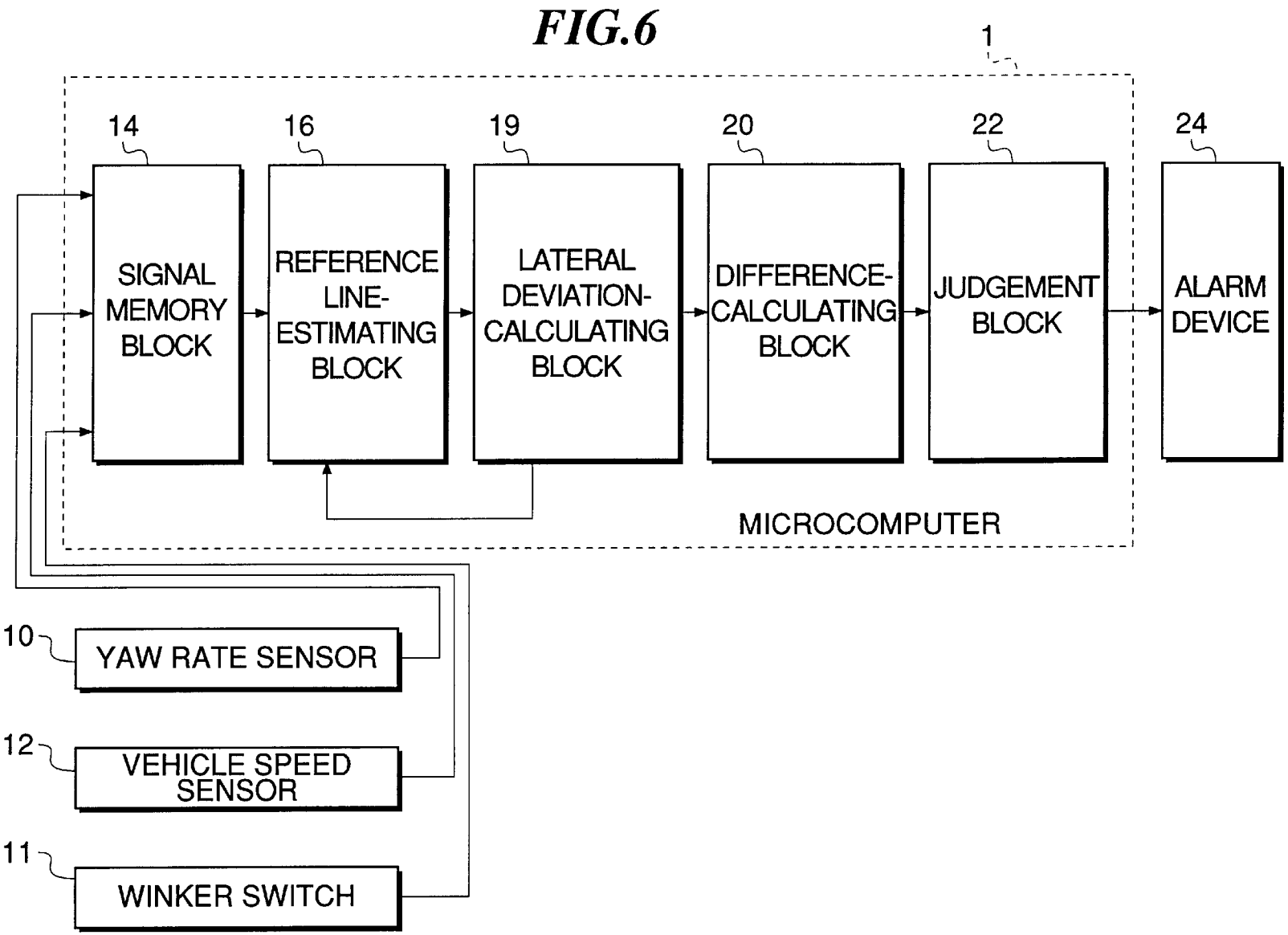
FIG. 6 is a block diagram showing the arrangement of a driving state-monitoring apparatus for an automotive vehicle, according to a second embodiment of the invention.

FIG. 6 shows the arrangement of a driving state-monitoring apparatus for an automotive vehicle, according to a second embodiment of the invention. The monitoring apparatus according to this embodiment is distinguished from the first embodiment described above only in that it is provided with a lateral deviation-calculating block 19 in place of the lateral deviation differential quantity-calculating block 18 while the reference value-estimating block 25 is omitted, and the difference-calculating block 20 calculates the deviation not based on the lateral deviation differential quantity DYK but based on a lateral deviation YK.

Figure 7:
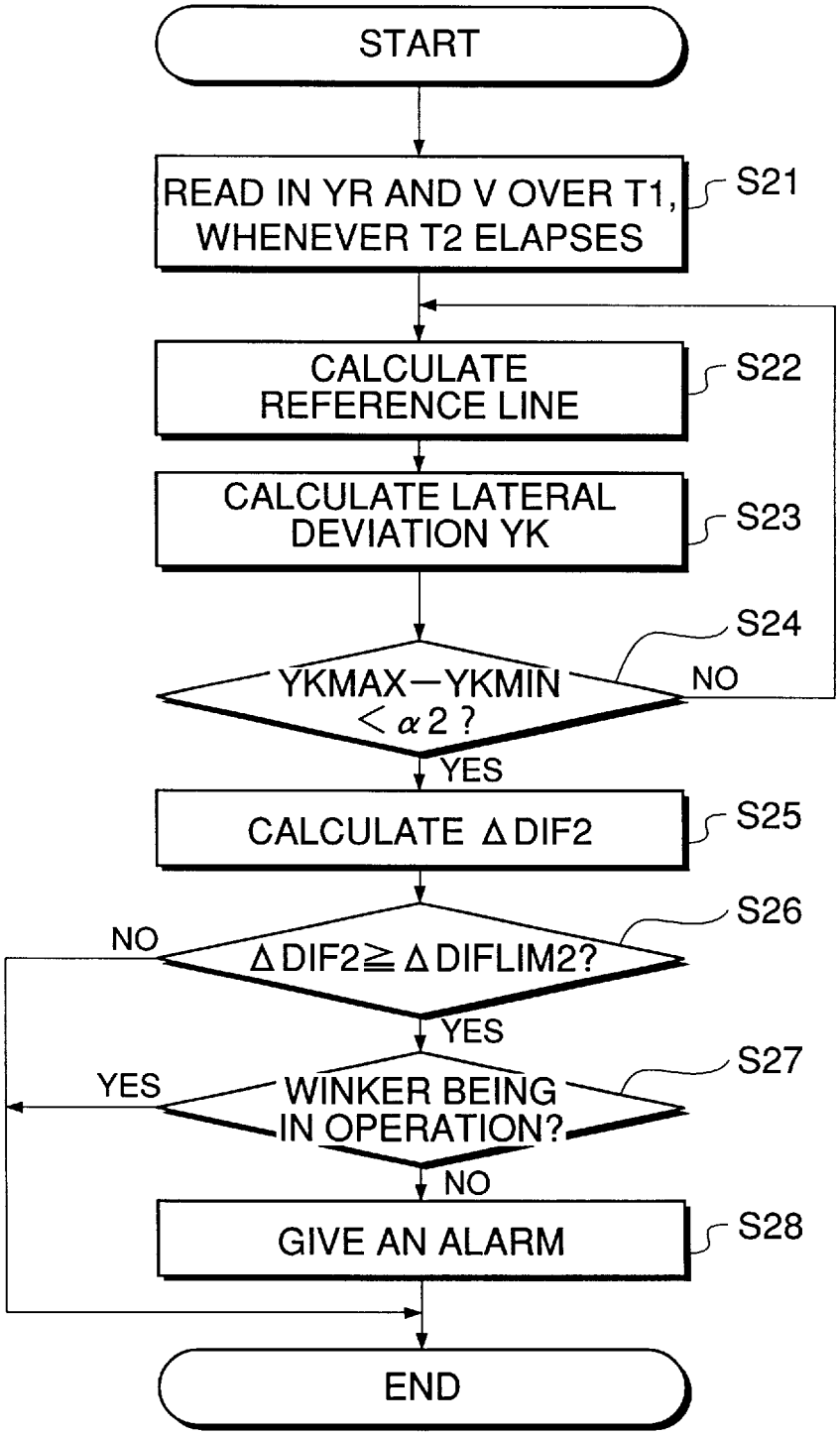
FIG. 7 is a flowchart showing a program for carrying out monitoring processing, which is executed by a microcomputer appearing in FIG. 6.

FIG. 7 shows a control processing routine executed by the microcomputer 1 of the present embodiment for monitoring the driving state of the driver. The operation of the present embodiment will be described with reference to the FIG. 7 routine.

Figure 2E:
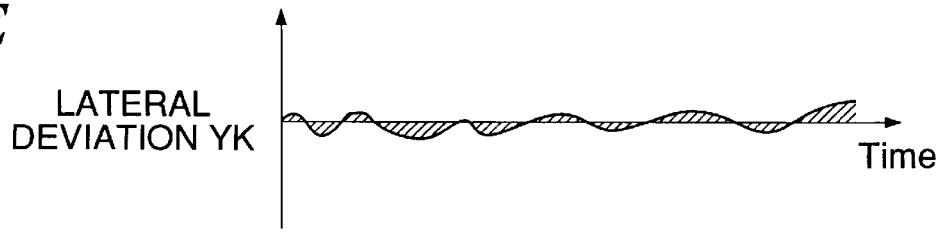

First, at steps S21 and S22, data of the yaw rate YR and the vehicle speed V are read in similarly to the steps S11 and S12 of FIG. 3, to thereby calculate the reference line. At a step S23, the lateral deviation differential quantity DYK is calculated based on the modified yaw angle YAM and the vehicle velocity V in the manner described before, and then the lateral deviation differential quantity DYK is subjected to time integration, i.e. integrated with respect to time, to thereby calculate the lateral deviation YK (FIG. 2E).

Then, it is determined at a step S24 whether or not the difference between the maximum value YKMAX of the lateral deviation YK and the minimum value YKMIN of the same is smaller than a predetermined value a $\alpha 2$. If (YKMAX−YKMIN)≧$\alpha 2$ holds, the program returns to the step S22, wherein the order of approximation is increased by one order to again calculate the reference line. This procedure is repeatedly carried out until the answer to the question of the step S24 becomes affirmative (YES).

It should be noted that the program may be configured such that the calculation of the reference line is terminated when the order of approximation of the reference line has reached a predetermined value, even if (DYKMAX−DYKMIN)≧$\alpha 2$ holds.

If (YKMAX−YKMIN)<$\alpha 2$ holds at the step S24, the program proceeds to a step S25, wherein a difference ΔDIF2 is calculated. The difference ΔDIF2 is calculated e.g. as the sum of the hatched areas shown in FIG. 2E which is obtained by time-integrating the absolute value of the lateral deviation YK. Alternatively, a standard deviation of the YK value or the difference between the maximum of the YK value and the minimum of the same may be used.

Then, it is determined at a step S26 whether or not the difference ΔDIF2 is equal to or larger than a reference value ΔDIFLIM2. If ΔDIF2≧ΔDIFLIM2 holds, it is determined at a step S27 whether or not the winker is in operation. If ΔDIF2<ΔDIFLIM2 holds or if the winker is in operation, the program is immediately terminated, whereas if ΔDIF2≧ΔDIFLIM2 holds and at the same time the winker is not in operation, it is determined that the driving state of the driver is abnormal, and a signal is delivered to the alarm device 24 to instruct the same to give an alarm.

As described above, according to the present embodiment, the reference line is calculated based on the yaw angle YA detected, and the driving state of the driver is determined based on the difference ΔDIF2 calculated from the lateral deviation YK, i.e. a deviation of the vehicle from the reference line. Therefore, it is possible to provide similar results to those in the first embodiment.

In the present embodiment as well, the reference value ΔDIFLIM2 may be updated based on the average value of the difference ΔDIF2 and the standard deviation of the same.

Figure 8:
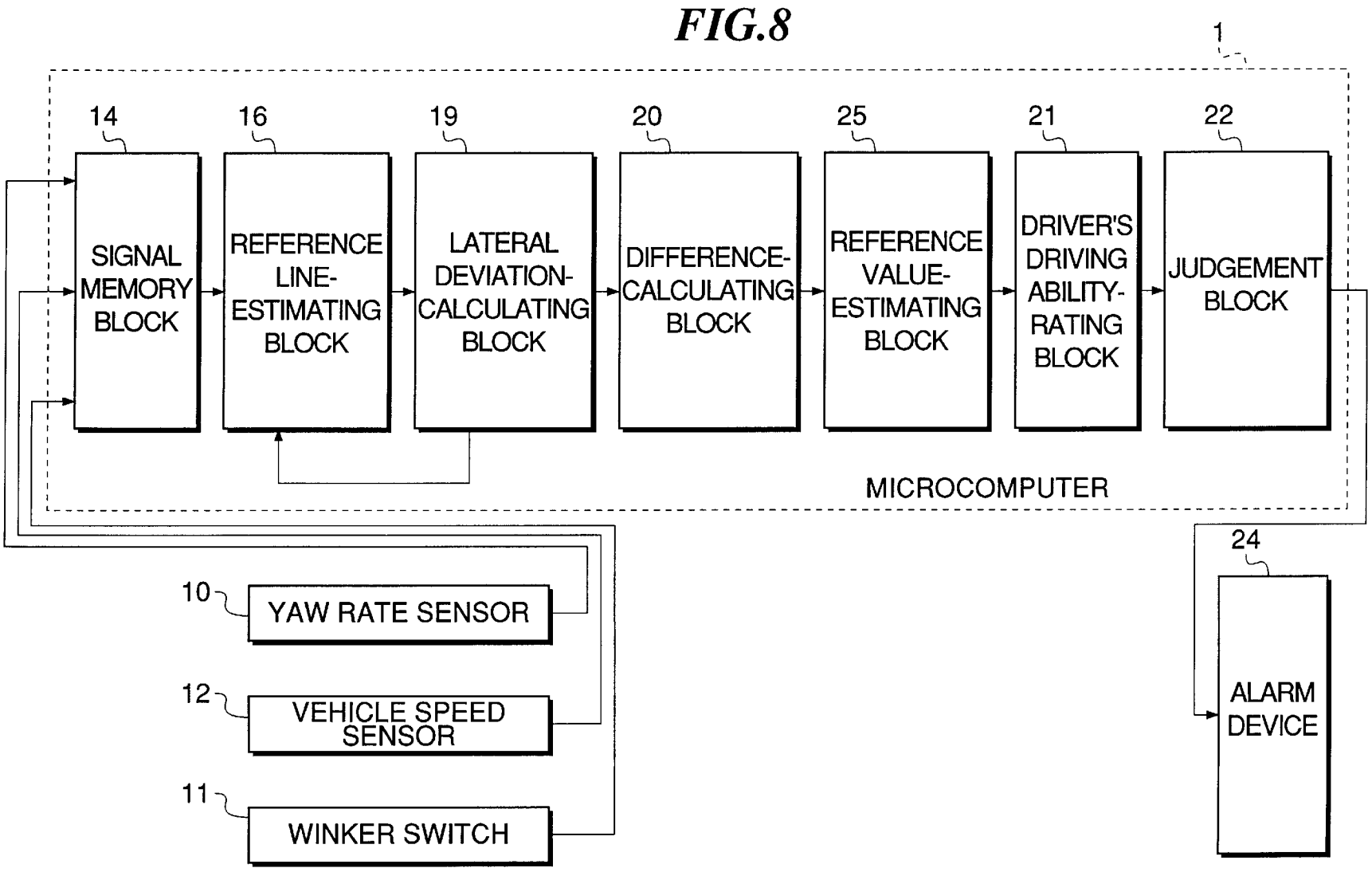
FIG. 8 is a block diagram showing the arrangement of a driving state-monitoring apparatus for an automotive vehicle, according to a third embodiment of the invention.

FIG. 8 shows the arrangement of a driving state-monitoring apparatus for an automotive vehicle, according to a third embodiment of the invention. The monitoring apparatus according to this embodiment is distinguished from the second embodiment described above only in that it is additionally provided with a reference value-estimating block 25 and a driver's driving ability-rating block 21 serially interposed between the difference-calculating block 20 and the judgement block 22. The reference value-estimating block 25 sets a reference value for use by the driver's driving ability-rating block 21.

Figure 9:
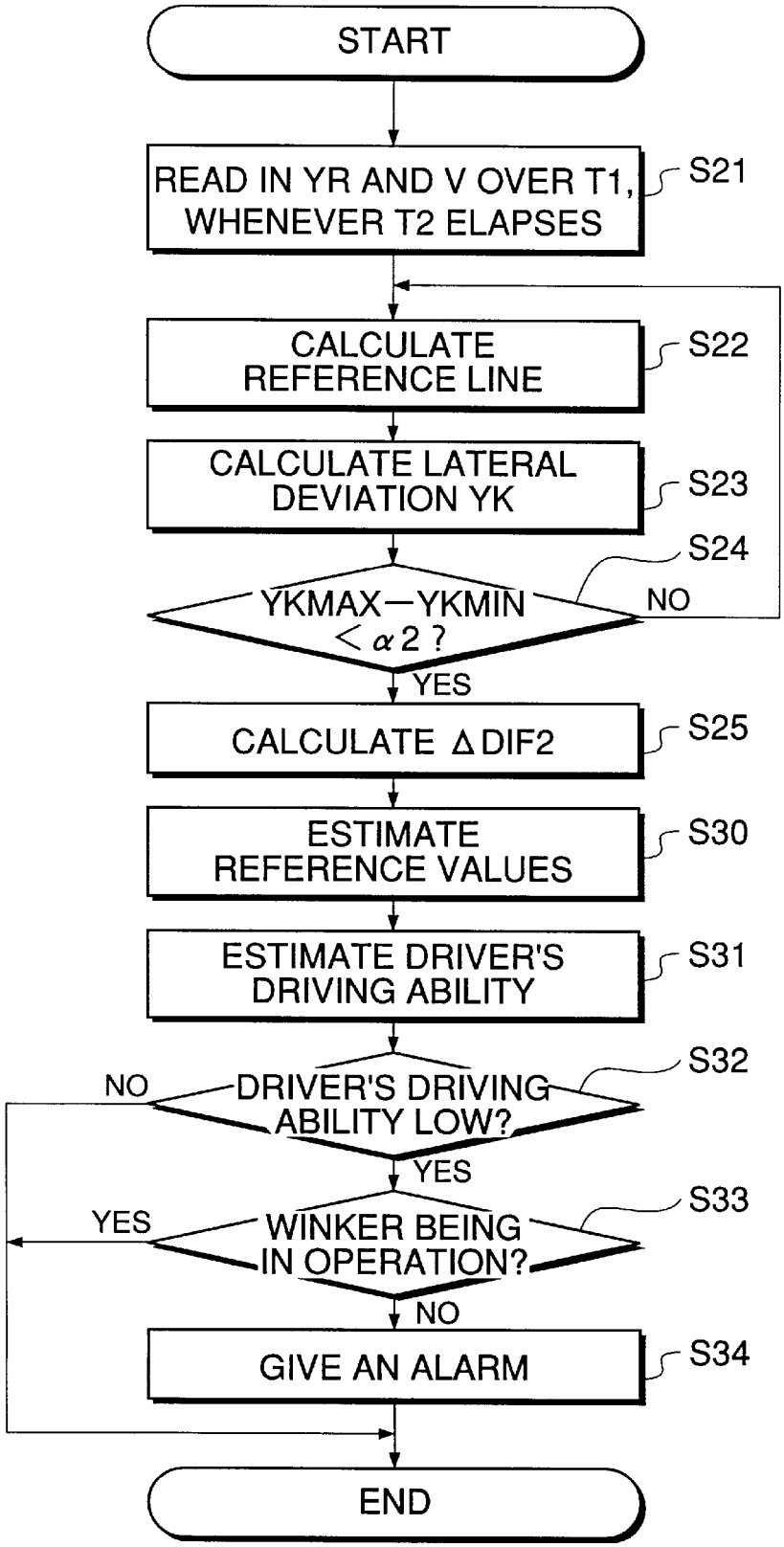
FIG. 9 is a flowchart showing a program for carrying out monitoring processing, which is executed by a microcomputer appearing in FIG. 8.

FIG. 9 shows a control processing routine executed by the microcomputer 1 of the present embodiment for monitoring the driving state of the driver. Steps S21 to S25 in FIG. 9 are identical to the steps S21 to S25 of FIG. 7, description of which is therefore omitted.

At a step S30, reference values ΔDIF2TH, ΔDIFTH, δTH(k), and ΔDIF3TH are calculated based on the difference ΔDIF2 calculated at the step S25.

More specifically, the difference ΔDIF2 is calculated m (e.g. 4) times and n (e.g. eight) times based on values of the yaw rate YR and values of the vehicle speed V sampled at respective different sampling time points. Then, an average value ΔDIFAVE of the thus obtained m values of the difference ΔDIF2 and a standard deviation δDIF of the same, and an average value ΔDIFAVE3 of the thus obtained n values of the difference ΔDIF2 are calculated. Then, whenever x (e.g. 30) values of each of the difference ΔDIF2, the average value ΔDIFAVE, the standard deviation δDIF, and the average value ΔDIFAVE3 are obtained, an average value MΔDIF2 of the difference ΔDIF2, an average value MΔDIFAVE of the average value ΔDIFAVE, an average value MδDIF of the standard deviation δDIF, and an average value MΔDIFAVE3 of the average value ΔDIFAVE3, as well as a standard deviation SΔDIF2 of the difference ΔDIF2, a standard deviation SΔDIFAVE of the average value ΔDIFAVE, a standard deviation SδDIF of the standard deviation δDIF, and a standard deviation S ΔDIFAVE3 of the average value ΔDIFAVE3 are calculated, and the reference values ΔDIF2TH, ΔDIFTH, δTH(k), and ΔDIF3TH for use at the following step S31, referred to hereinafter, are updated by the use of the following equations (6) to (9):

$$\Delta DIF2TH(k)=min(\Delta DIF2TH(k-1),\ C1\times M\Delta DIF2+d1\times S\Delta DIF2) \quad (6)$$

$$\Delta DIFTH(k)=min(\Delta DIFTH(k-1),\ C2\times M\Delta DIFAVE+d2\times S\Delta DIFAVE) \quad (7)$$

$$\delta TH(k)=min(\Delta\delta TH(k-1),\ C3\times M\delta DIF+d3\times S\delta DIF) \quad (8)$$

$$\Delta DIF3TH(k)=min(\Delta DIF3TH(k-1),\ C4\times M\Delta DIFAVE3+d4\times M\Delta DIFAVE3) \quad (9)$$

where C1 to C4 and d1 to d4 represent respective predetermined values, and (k) and (k−1) indicate that values with these suffixes are obtained in the present loop and the immediately preceding loop, respectively. At the start of driving of the vehicle, the reference values ΔDIF2TH, ΔDIFTH, δTH(k), and ΔDIF3TH are set to respective predetermined initial values.

By executing the step S30, the reference values are each decreased from their initial values applied when the driver started driving the vehicle, based on the average value M and the standard value S of each corresponding parameter.

Figures 10, 11:
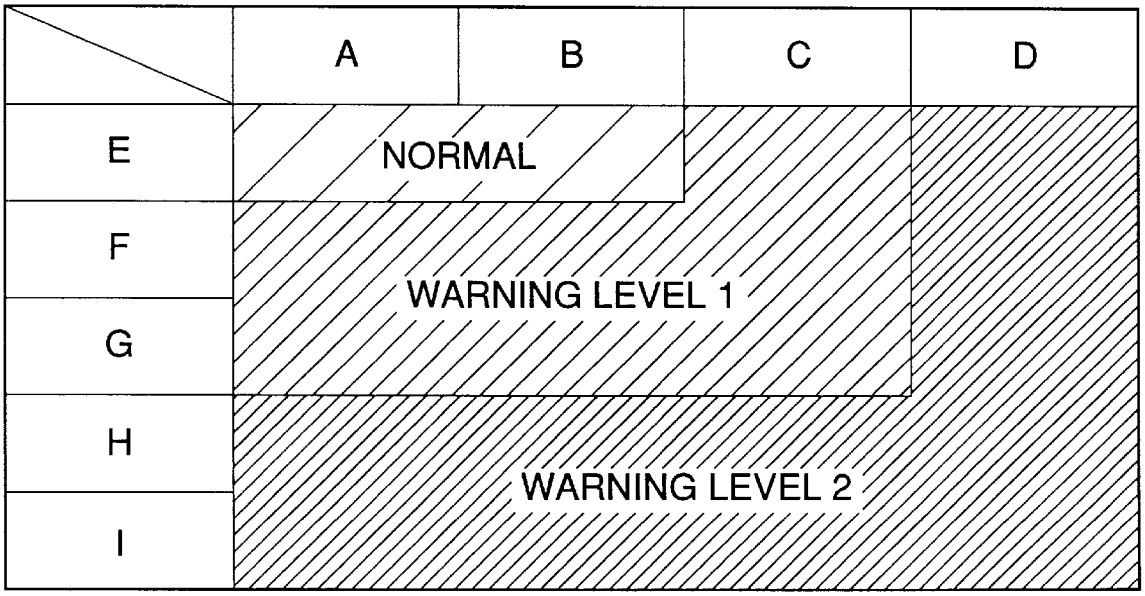
FIG. 10 shows a map for use in determining the level of the driver's driving ability.
FIG. 11 shows another map for use in determining the level of the driver's driving ability.

At a step S31, the driver's driving ability is rated based on the difference ΔDIF2 calculated at the step S25. This rating is carried out in the following manner:

First, the difference ΔDIF2 is calculated m times (e.g. 4 times) based on respective m values of the yaw rate YR and respective m values of the vehicle speed V which have been sampled at different sampling time points from each other, and n (e.g. 8) times based on respective n values of the yaw rate YR and respective n values of the vehicle speed V which have been sampled at different sampling time points from each other. Further, an average value ΔDIFAVE of the m values of the difference ΔDIF2 and a standard deviation δDIF thereof and an average value ΔDIFAVE3 of the n values of the difference ΔDIF2 are calculated. Then, the driver's driving ability is estimated at one of levels A to D as shown in FIG. 10, depending on whether the average value ΔDIFAVE is larger than the reference value ΔDIFTH and whether the standard deviation δDIF is larger than the reference value δTH. If ΔDIFAVE≧ΔDIFTH holds and at the same time δDIF≧δTH holds, which means that the difference is small on the average and undergoes little variation, the driver's driving ability is estimated to be the highest (level A). On the other hand, if ΔDIFAVE>ΔDIFTH holds and at the same time δDIF≧δTH holds, which means that the difference is large on the average and at the same time undergoes little variation, the driver's driving ability is estimated to be the lowest (level D). Further, if δDIF>δTH holds, it is presumed that the driver has higher driving ability as the average value ΔDIFAVE is smaller. Therefore, in this case, if ΔDIFAVE>ΔDIFTH holds, the driver's driving ability is estimated at the level B, while if ΔDIFAVE>ΔDIFTH, it is estimated at the level C.

Further, the number NOV (=0 to m) of ones of the m ΔDIF2 values which exceed the reference value ΔDIF2TH is determined, and based on the NOV value, the driver's driving ability is estimated at one of levels of E to I. More specifically, in the case of m=4, the driver's driving ability is rated at levels E, F, G, H, I, according to NOV=0, 1, 2, 3, 4, respectively.

Then, as shown in FIG. 11, the driver's driving ability is synthetically determined based on the levels A to C and E to I explained above. More specifically, if the driver's driving ability is at the level A or B and at the same time at the level E, or if ΔDIFAVE3<ΔDIF3TH holds, it is judged that the driver's driving ability is normal. If the driver's driving ability is at the level A or B, and at the same time at the level F or G and at the same time ΔDIFAVE3≧ΔDIF3TH holds, or the driver's driving ability is at the level C and at the same time at the level E,F, or G, and at the same time ΔDIFAVE3≧ΔDIF3TH holds, it is judged that the driver's driving ability is at a warning level 1, and if the same is at the level A, B or C and at the same time at the level H or I, and at the same time ΔDIFAVE3≧ΔDIF3TH holds, or the driver's driving ability is at the level D and at the same time ΔDIFAVE3≧ΔDIF3TH holds, it is judged that the driver's driving ability is at a warning level 2.

Alternatively, without using the average value ΔDIFAVE3 of the n values of the difference ΔDIF, if the driver's driving ability is at the level A or B and at the same time at the level E, the driver's driving ability may be judged to be normal, whereas if the driver's driving ability is at the level A or B and at the same time at the level F or G, or at the level C and at the same time at the level E, F or G, the driver's driving ability may be judged to be at the warning level 1, and similarly, if the driver' driving ability is at the level A, B or C and at the same time at the level H or I, or at the level D, the driver's driving ability may be judged to be at the warning level 2.

In this way, the driver's driving ability is determined based on an average value of a plurality of values of the difference ΔDIF2 and the degree of variation between them, whereby it is possible to accurately determine the driver's driving ability.

Referring again to FIG. 9, it is determined at a step S32 whether or not the driver's driving ability is low, more specifically, whether or not the driver's driving ability was rated at the warning level 1 or the warning level 2 at the step S31. If the answer to this question is affirmative (YES), it is determined at a step S33 whether or not the winker is in operation. If the driver's driving ability is neither at the warning level 1 nor at the warning level 2, or the winker is in operation, the program is immediately terminated. On the other hand, if the driver's driving ability is at the warning level 1 or the warning level 2, and at the same time the winker is not in operation, it is judged that the driving state of the driver is abnormal, and a signal is delivered to the alarm device 24 to give an alarm.

Here, if the driver's driving ability is at the warning level 2, it is preferred, for example, that the alarming is made by a larger sound than when it is at the warning level 1, or by lighting an alarm lamp and sounding a buzzer concurrently. Further, a fail-safe operation, such as deceleration of the vehicle, may be employed if the driver's driving ability is at the warning level 2.

As described above, according to the third embodiment, by determining the driver's driving ability based on an average value of a plurality of values of the difference ΔDIF2 and the variation between them, it is possible to determine or rate the driver's driving ability more accurately, which makes it possible to carry out alarming, and more desirably, a fail-safe action, in a more appropriate manner.

Further, since the reference values used in determining the driver's driving ability are each decreased from their initial values applied when the driver started driving the vehicle, based on the average value M and the standard value S of each corresponding parameter, it is possible to quickly determine whether or not the driving state of the driver is abnormal while preventing the driving state of the driver from being erroneously determined to be abnormal immediately after the driver starts driving the vehicle.

In the present embodiment as well, variations similar to those described with reference to the first embodiment are possible, as follows:

(1) The updating of the reference values ΔDIF2TH, ΔDIFTH, δTH, and ΔDIF3TH by the use of the equations (6) to (9) may be inhibited once it is determined that the driving state of the driver is abnormal for the first time after the driver started driving the vehicle.

(2) The reference values ΔDIF2TH, ΔDIFTH, δTH, and ΔDIF3TH may be held at respective initial values before a predetermined time period THOLD elapses after the driver started driving the vehicle, without executing the updating of these values by the use of the equations (6) to (9).

(3) The driving state-monitoring apparatus may be configured such that alarming is inhibited before a predetermined no-alarm time period TNWARN elapses after the driver started driving the vehicle. Further, the FIG. 9 program may be configured such that within the predetermined no-alarm time period, the program is immediately terminated after executing the step S25. Further, the same program may be configured such that within the predetermined no-alarm time period TNWARN, the execution of the step S21 et seq. is inhibited provided that the detected values of the vehicle speed V and/or the yaw rate YR are smaller than respective predetermined values.

Figure 13:
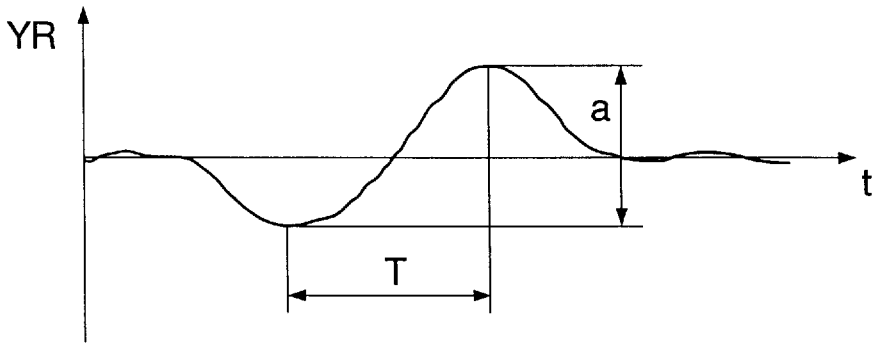
FIG. 13 is a graph which is useful in explaining a manner of determination as to whether or not the traffic lane on which the vehicle is traveling has been changed.

Next, a fourth embodiment of the invention will be described with reference to FIGS. 12 and 13.

Figure 12:
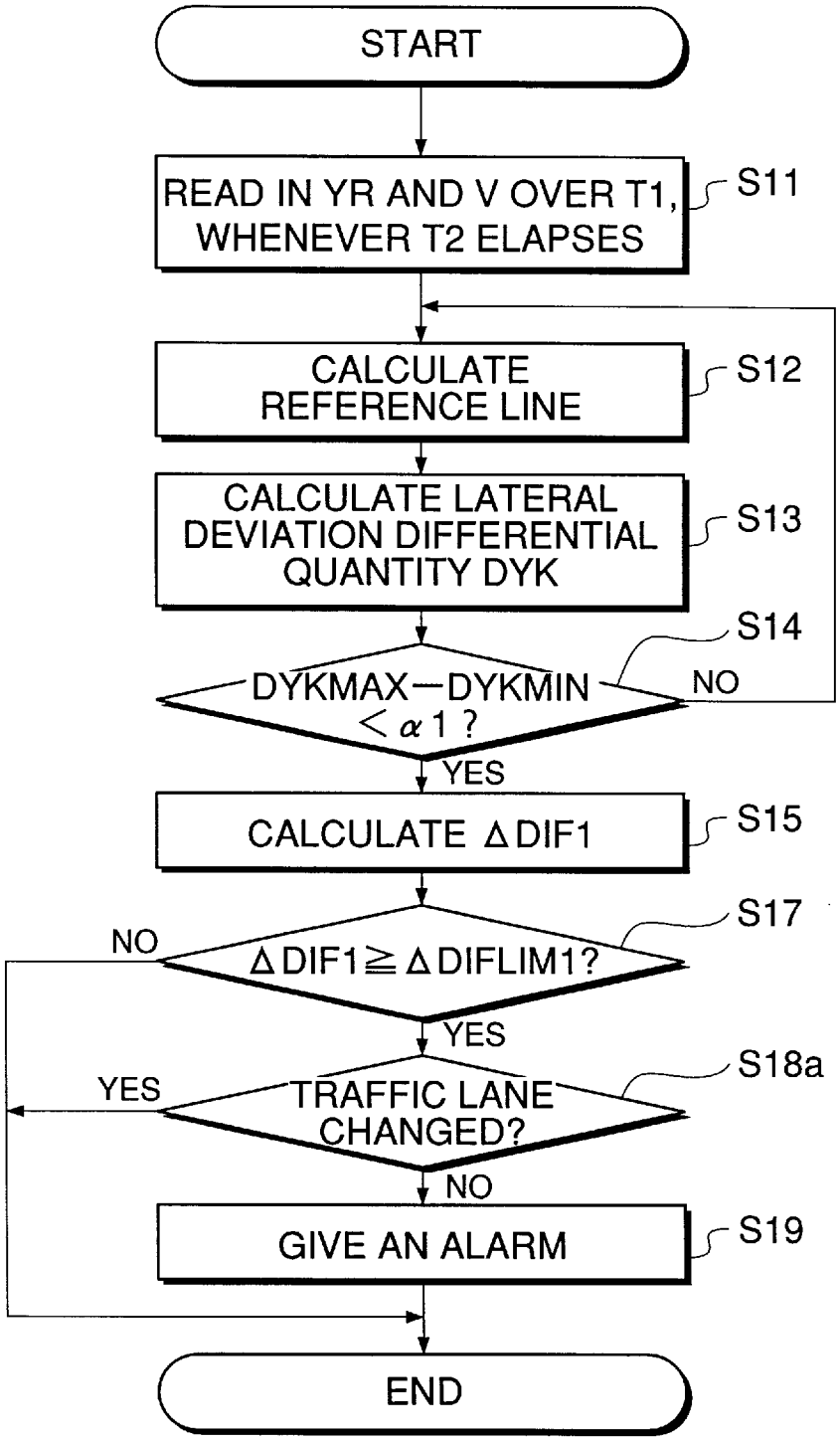
FIG. 12 is a flowchart showing a modification of the program shown in FIG. 3, which is executed by a fourth embodiment of the invention.

FIG. 12 is distinguished from FIG. 3 only in that the step S16 in FIG. 3 is omitted, and the step S18 is replaced by a step S18*a*.

At the step S18*a*, it is determined whether traffic lane on which the vehicle is traveling has been changed. If the traffic lane has been changed, the present program is immediately terminated, whereas if the traffic lane has not been changed, it is determined that the driving state of the driver is abnormal, and a signal is delivered to the alarm block 24 to give an alarm.

The determination as to whether the traffic lane has been changed is carried out in the following manner: It is known that the yaw rate YR changes as shown in FIG. 13 when the traffic lane is changed. Therefore, measurements are made of a time period T from a time point at which the yaw rate YR exhibits a peak in one direction (e.g. in a rightward direction) and a time point at which the same exhibits a peak in the other direction (e.g. in a leftward direction), and of the difference a between values of these peaks (amplitude in the yaw rate). Then, if the time period T is within a range defined by predetermined values T1, T2 (T1>T2) and at the same time the amplitude a is larger than a predetermined value A, it is determined that the traffic lane has been changed.

According to this embodiment, it is possible to prevent an erroneous determination of the driving state of the vehicle even when the driver changes the traffic lane without operating the winker, thereby enhancing the accuracy of determination of the driving state of the driver.

Alternatively, at the step S18*a* in FIG. 12, it may be further determined whether or not a predetermined time period TARC has elapsed after the traffic lane was changed, and if the predetermined time period TARC has not elapsed, the program is immediately terminated whereas if the predetermined time period TARC has elapsed, the program proceeds to the step S9, whereby an alarm is given after the lapse of the predetermined time period TARC after the traffic lane was changed.

Further, the updating of the reference value ΔDIFLIM1 may be carried out in the same manner as in the first embodiment.

As a further variation of the embodiments of the invention, the same determination as that carried out at the step S18*a* may be carried out at the step S27 in FIG. 7 (second embodiment) or at the step S33 in FIG. 9 (third embodiment).

Also, in the first to third embodiments, the determination as to whether the winker is in operation (at the step S18 in FIG. 3, at the step S27 in FIG. 7, and at the step S33 in FIG. 9) may be made immediately after data of the yaw rate YR and the vehicle speed V are obtained (at the step S11 in FIG. 3, and at the step S21 in FIGS. 7 and 9), and if the winker is in operation, the program may be immediately terminated without executing calculation of the reference line, etc.

Further, although in the first to third embodiments, the parameters (ΔDIF1, ΔDIF2, ΔDIFAVE) indicative of the behavior of the vehicle are employed to update the reference values used in determining abnormality of the driving state of the driver, this is not limitative, but the updating of the reference values may be applied to other methods of determining abnormality of the driving state of the driver.

That is, reference values used may be updated in the manner described hereinabove in executing, e.g. a method of determining a doze of the driver based on the frequency of operations of the steering wheel and the accelerator pedal as disclosed by Japanese Patent Publication (Kokoku) No. 54-24569, a method of detecting the position of an upper part of the driver's body by a camera and determining driver dozing based on periodic changes in the detected position of the upper part of the driver's body as disclosed by Japanese Patent Publication (Kokoku) No. 4-75560, a method of detecting an electric potential on the skin of the driver and detecting a strained state and a lowered awakeness state of the driver based on the detected potential as disclosed by Japanese Laid-Open Patent Publication (Kokai) No. 5-24460, a method of detecting a doze of the driver based on information on a driver's body, such as an electroencephalogram, a countenance, and body temperature as disclosed by Japanese Laid-Open Patent Publication (Kokai) No. 5-96971, and a method of picking up an image of a road in front of the running vehicle by a camera to thereby detect transverse displacement of the running vehicle, and detecting a doze of the driver based on the detected transverse displacement as disclosed in Japanese Laid-Open Patent Publication (Kokai) No. 5-69757, etc. In short, the method of updating reference value(s) employed in the present embodiments of the invention is applicable not only to determination of a dozing driving of the vehicle based on the behavior of the vehicle, but also to determination of a dozing driving of the vehicle based on driving operations, or states or conditions (posture, body temperature, etc.) of the driver.

Further, although in the above described embodiments, the driver is cautioned by appealing to his sight and/or hearing, this not limitative, but means of directly applying physical forces or stimulations on the driver may be employed, e.g. by vibrating the driver's seat, or by applying tension to the seat belt, or by emitting a perfume, or by changing the operating condition of an air conditioner provided in the vehicle. This ensures that the driver is cautioned of his degraded driving ability in a more positive manner.

Still further, although in the above embodiments, the yaw rate is detected by the yaw rate sensor 10, this is not limitative, but the yaw rate may be calculated based on outputs from wheel speed sensors and the vehicle speed sensor, or based on outputs from a steering angle sensor for detecting the steering angle of the steering wheel and a lateral acceleration sensor, etc.

Even further, although in the above embodiments, the reference line is estimated from the yaw angle YA, this is not limitative, but it may be estimated from the yaw rate YR, or the lateral deviation YK.

What is claimed is:

1. A driving state-monitoring apparatus for an automotive vehicle, for monitoring a driving state of a driver of said automotive vehicle, comprising:

driving state parameter-calculating means for calculating a driving state parameter indicative of said driving state of said driver based on at least one of behavior of said automotive vehicle, a driving operation of said driver, and a condition of said driver;

comparison means for comparing said driving state parameter with a reference value;

determining means for determining whether or not said driving state of said driver is normal based on a result of said comparison by said comparison means; and reference value-changing means for changing said reference value based on said driving state parameter calculated by said driving state parameter-calculating means, in such a direction that it becomes less possible to determine that said driving state of said driver is normal, wherein said reference value-changing means progressively changes said reference value based on said driving state parameter calculated by said driving state parameter calculating means in such a direction that it becomes less possible to determine that said driving state of said driver is normal, after said automotive vehicle is started.

2. A driving state-monitoring apparatus according to claim 1, including inhibiting means for inhibiting said reference value-changing means from changing said reference value once said determining means determines that said driving state of said driver is not normal.

3. A driving state-monitoring apparatus according to claim 1, including inhibiting means for inhibiting said reference value-changing means from changing said reference value before a predetermined time period elapses after said automotive vehicle is started.

4. A driving state-monitoring apparatus according to claim 2, including inhibiting means for inhibiting said reference value-changing means from changing said reference value before a predetermined time period elapses after said automotive vehicle is started.

5. A driving state-monitoring apparatus according to claim 1, including alarm means for giving an alarm when said determining means determines that said driving state of said driver is not normal, and inhibiting means for inhibiting said alarm means from giving said alarm before a predetermined time period elapses after said automotive vehicle is started.

6. A driving state-monitoring apparatus according to claim 3, including alarm means for giving an alarm when said determining means determines that said driving state of said driver is not normal, and inhibiting means for inhibiting said alarm means from giving said alarm before a predetermined time period elapses after said automotive vehicle is started.

7. A driving state-monitoring apparatus according to claim 3, including alarm means for giving an alarm when said determining means determines that said driving state of said driver is not normal, and inhibiting means for inhibiting said alarm means from giving said alarm before a predetermined time period elapses after said automotive vehicle is started.

8. A driving state-monitoring apparatus according to claim 1, including lane changing intention-determining means for determining whether or not said driver intends to change a lane on which said automotive vehicle is traveling, and inhibiting means for inhibiting said determining means from carrying out said determination as to normality of said driving state of said driver based on said result of said comparison by said comparison means when said lane changing intention-determining means determines that the driver intends to change the lane.

9. A driving state-monitoring apparatus according to claim 1, including vehicle speed-limiting means responsive to said determination by said determining means that said driving state of said driver is not normal, for limiting said speed of said automotive vehicle.

10. A driving state-monitoring apparatus according to claim 1, wherein said automotive vehicle includes equipment installed on said automotive vehicle for directly applying a physical force or stimulation on said driver, said apparatus including vehicle equipment control means responsive to said determination by said determining means that said driving state of said driver is not normal, for controlling said equipment.

11. A driving state-monitoring apparatus according to claim 1, including initial value-setting means for setting said reference value to an initial value when said automotive vehicle is started, and wherein after said automotive vehicle is started, said reference value-changing means calculates a new value of said reference value based on an average value of said driving state parameter and a standard deviation of said driving state parameter, and updates said reference value by said new value of said reference value.

12. A driving state-monitoring apparatus according to claim 1, including lane change determining means for determining whether or not the vehicle has changed a lane on which the automotive vehicle is traveling, and inhibiting means for inhibiting said determining means from carrying out said determination as to normality of said driving state of said driver based on said result of said comparison by said comparison means when said lane change determining means determines that the vehicle has changed the lane.

13. A driving state-monitoring apparatus according to claim 1, wherein said reference value-changing means always changes said reference value in such a direction that it becomes less possible to determine that the driving state of the driver is normal.

14. A driving state monitoring, apparatus according to claim 1 further including a vehicle speed sensor and a vehicle lateral deviation behavior sensor; and said driving parameter-calculating means calculates said driving state parameter based on outputs of said vehicle speed sensor and said vehicle lateral deviation behavior sensor.

15. A driving state-monitoring apparatus for an automotive vehicle, for monitoring a driving state of said automotive vehicle, comprising:

driving state parameter-calculating means for calculating a driving state parameter indicative of said driving state of said driver based on at least one of behavior of said automotive vehicle, a driving operation of said driver, and a condition of said driver;

comparison means for comparing said driving state parameter with a reference value;

determining means for determining weather or not said driving state of said driver is normal based on a result of said comparison by said comparison means; and reference value-changing means for changing said reference based on said driving state parameter calculated by said driving state parameter-calculating means, in such a direction that it becomes less possible to determine that said driving state of said driver is normal;

said driving state parameter-calculating means includes behavior parameter-detecting means for detecting a behavior parameter indicative of an amount behavior related to at least one of yawing movement and lateral movement of said automotive vehicle, vehicle-speed detecting means for detecting a speed of said automotive vehicle, behavior reference parameter-setting means for setting a behavior reference parameter based on changes in said behavior parameter, and lateral deviation behavior amount-calculating means for calculating a lateral deviation behavior amount of said automotive vehicle, based on said behavior parameter, said behavior reference parameter, and said speed of said automotive vehicle, and said driving state parameter-calculating means calculates said driving state parameter based on said lateral deviation behavior amount of said automotive vehicle.

16. A driving state-monitoring apparatus for an automotive vehicle, for monitoring a driving state of a driver of said automotive vehicle, comprising:

driving state parameter-calculating means for calculating a driving state parameter indicative of said driving state of said driver based on at least one of behavior of said automotive vehicle, a driving operation of said driver, and a condition of said driver;

comparison means for comparing said driving state parameter with a reference value;

determining means for determining whether or not said driving state of said driver is normal based on a result of said comparison by said comparison means; and reference value-changing means for changing said reference value based on said driving state parameter calculated by said driving state parameter-calculating means, in such a direction that it becomes less possible to determine that said driving state of said driver is normal wherein said comparison means compares an average value of said driving state parameter and a variation of said driving state parameter with respective reference values, said determining means including driving ability-determining means for determining a driving ability of said driver based on said result of said comparison by said comparison means, said determining means determining whether or not said driving state of said driver is normal, based on a result of said determination by said driving ability-determining means.

* * * * *

UNITED STATES PATENT AND TRADEMARK OFFICE

CERTIFICATE OF CORRECTION

PATENT NO : 5,815,070

DATED : 29 September 1998

INVENTOR(S) : Kenji Yoshikawa

It is certified that error appears in the above-identified patent and that said Letters Patent is hereby corrected as shown below:

Column 8, line 26, change "a $\alpha 2$" to --$\alpha 2$--.

Column 9, line 15, change "$\delta TH(k)$" to --$\sigma TH(k)$--;
line 22, change "$\delta DIF$" to --$\sigma DIF$--;
line 26, change "$\delta DIF$" to --$\sigma DIF$--;
line 30, change "$M\delta DIF$" to --$M\sigma DIF$--; change "$\delta DIF$" to --$\sigma DIF$--;
line 34, change "$S\delta DIF$" to --$S\sigma DIF$--;
line 35, change "$\delta DIF$" to --$\sigma DIF$--;
line 37, change "$\delta TH(k)$" to --$\sigma TH(k)$--;
approximately line 44 (equation (8)),
change "$\delta TH(k) = \min(\Delta\delta TH(k-1), C3 \times M\delta DIF + d3 \times S\delta DIF)$"
to --$\sigma TH(k) = \min(\Delta\sigma TH(k-1), C3 \times M\sigma DIF + d3 \times S\sigma DIF)$--;
line 53, change "$\delta TH(k)$" to --$\sigma TH(k)$--.

Column 10, line 4, change "$\delta DIF$" to --$\sigma DIF$--;
line 9, change "$\delta DIF$" to --$\sigma DIF$--;
line 10, change "$\delta TH$" to --$\sigma TH$--; change "$\geq$" to --$\leq$--;
line 11, change "$\delta DIF \geq \delta TH$" to --$\sigma DIF \leq \sigma TH$--;
line 15, change "$\delta DIF \geq \delta TH$" to --$\sigma DIF \leq \sigma TH$--;
line 18, change "$\delta DIF > \delta TH$" to --$\sigma DIF > \sigma TH$--;
line 21, change ">" to --$\leq$--.

Column 11, 40th line, change "$\delta TH$" to --$\sigma TH$--;
line 44, change "$\delta TH$" to --$\sigma TH$--.

UNITED STATES PATENT AND TRADEMARK OFFICE

CERTIFICATE OF CORRECTION

PATENT NO : 5,815,070

DATED : 29 September 1998

INVENTOR(S) : Kenji Yoshikawa

It is certified that error appears in the above-identified patent and that said Letters Patent is hereby corrected as shown below:

Column 14, line 23 (claim 6, line 2), change "3" to --2--.

Column 15, line 15 (claim 14, line 1), change "state monitoring" to --state-monitoring--;
23rd line (claim 15, line 2), after "state" insert --of a driver--;
32nd line (claim 15, line 11), change "weather" to --whether--;
36th line (claim 15, line 15), before "based" insert --value--;
42nd line (claim 15, line 21), before "behavior" insert --of--.

Column 16, 32nd line (claim 16, line 19), after "normal" insert a comma.

Signed and Sealed this

Fourth Day of May, 1999

*Attest:*

Q. TODD DICKINSON

*Attesting Officer*

*Acting Commissioner of Patents and Trademarks*